United States Patent [19]

Mori

[11] 4,003,512

[45] Jan. 18, 1977

[54] APPARATUS FOR SEQUENTIALLY AND SIMULTANEOUSLY DRIVING PLURAL PAIRS OF FEED ROLLERS

[76] Inventor: Ikuji Mori, 26-6, Unoki 3-chome, Ota, Tokyo, Japan

[22] Filed: Sept. 11, 1974

[21] Appl. No.: 505,099

[30] Foreign Application Priority Data

Sept. 29, 1973 Japan ..... 48-109532

[52] U.S. Cl. ..... 226/188; 134/64 P; 354/321

[51] Int. Cl.[2] ..... B65H 17/22

[58] Field of Search ..... 226/113, 188, 189; 134/64 P; 354/297, 319, 320, 321, 322, 339

[56] References Cited

UNITED STATES PATENTS

| | | | |
|---|---|---|---|
| 2,428,790 | 10/1947 | Dye et al. | 354/321 X |
| 2,853,294 | 9/1958 | Woodcock | 354/321 X |
| 3,520,461 | 7/1970 | Savela | 226/189 X |
| 3,785,543 | 1/1974 | Lee | 226/188 |

*Primary Examiner*—Fred L. Braun
*Attorney, Agent, or Firm*—James E. Nilles

[57] ABSTRACT

An apparatus for developing elongated photographic films, wherein a processing film is fed through a number of paired film feed rollers which are located along a predetermined film passage over a number of treating baths including at least a developing bath, a fixing bath and a washing bath. The paired film feed rollers are driven sequentially from the preceding pair at suitable time lags for forming loops of draped film in each of the developing fixing and washing baths to effect the whole film processing operations automatically.

3 Claims, 11 Drawing Figures

APPARATUS FOR SEQUENTIALLY AND SIMULTANEOUSLY DRIVING PLURAL PAIRS OF FEED ROLLERS

BACKGROUND OF THE INVENTION

1. Field of the Invention

This invention relates to a method and apparatus for automatically processing elongated photographic films for developing, fixing and washing purposes.

Elongated photographic films as herein used include those photographic films which are usually provided in the length of 100 feet, including the motion picture films of 8mm, 35mm, 70mm and 100mm in width, as well as the screen and non-screen type roll films generally used in X-ray examinations. Also included are relatively short roll films which are used in still photography. It should be understood that the present invention can also be suitably applied to those films which have a length greater than 100 feet, if necessary, should they become popular in the future. Briefly, the "elongated film" may be of any length and width and it may be regarded as a photographic film which has a length greater than its width and which is generally provided in the form of a roll.

2. Description of the Prior Art

In order to process exposed elongated films, it is well known to pass them sequentially through a developing bath, a fixing bath and washing bath in such a manner that they are allowed to stay in each bath for a predetermined period of time, and there have hitherto been introduced a variety of methods and apparatuses for processing elongated films on this known principle. In order to assist the understanding of the present invention, some typical prior art methods and apparatuses are discussed hereinafter.

In one prior-art film processing apparatus, each bath is provided with paired feed rollers and the film is transferred through the respective baths under the guidance of the feed rollers provided therein.

Each treating bath is formed with film guide grooves, for example, of U-shape on opposing side walls thereof for engagement with longitudinal side edges portions of the film under treatment so that the film is guided along the guide grooves into and out of the treating solution in each bath. In certain cases, paired guide rolls are provided at suitable positions in the bath to cooperate with the guide grooves in moving the film into and out of the treating solution.

The overhead paired film feed rollers are located above a number of treating baths which are positioned one after another along the path of travel of the film. It is the general practice to provide vertically movable rollers between the respective pairs of the film feed rollers to immerse the film forcibly in the treating solution in a looped form with the downward movement of the roller.

There have been proposed and put in use many other elongated film processing methods and apparatus but they have a common drawback in that it is necessary to provide a film guiding mechanism integrally with the treating bath or a film guiding mechanism which is adapted to be immersed in the treating solution together with the film. This obviously requires a treating bath of a relatively large size and therefore results in increased consumption of the treating solution. Furthermore, the immersion of the film guide mechanism gives rise to various troubles.

In the prior-art film processing apparatus where the film guide mechanism is provided as an integral part of the treating bath, it is difficult to construct the film feed mechanism so as to be separable from the treating bath and free from the treating solution, so that the processing apparatus as a whole has to be fabricated in a large size which requires increased maintenance work.

SUMMARY OF THE INVENTION

It is the general object of the present invention to provide a method and apparatus for effecting the film processing operations automatically by forming draped film loops within the respective treating baths without providing any film guide mechanism within the baths.

Since the film under treatment is draped to form loops in the respective treating baths, it becomes possible to reduce the distance between the adjacent paired film feed rollers of the film transfer unit which is located along and over the respective treating baths. This means that the processing apparatus can be constructed in an extremely small size. It is thus another object of the present invention to reduce the size of the film transfer unit to such a degree as to reduce the film processing apparatus as a whole.

It will be appreciated that the elimination of the film guide mechanism from the treating bath makes it possible to provide the film transfer unit separably from the respective film treating baths. It is a further object of the present invention to provide an elongated film processing apparatus which is provided with film treating baths and film transfer unit separable from each other for washing and cleaning purposes.

In the prior-art film processing apparatus mentioned hereinbefore, the length of the draped film loop is constant and no means is provided for adjusting it. However, in the present invention, it is possible to adjust the length of the draped film loops in the respective treating baths in accordance with the depth of the baths.

The film may be draped to form a loop having a length two or more times greater than the depth of the treating bath as the film flexes freely within the bath after reaching the tank bottom. Therefore, the processing time in each bath may be adjusted with ease and it becomes possible to employ treating baths of a smaller volume.

It is still another object of the present invention to provide an elongated film processing apparatus which has means for forming draped film loops in the respective film treating baths.

In order to form draped film loops within the consecutively provided film treating baths, a number of paired film feed rollers which are aligned along the film passage are driven in two different modes of operation. More particularly, all the film feed rollers are driven simultaneously at a uniform speed in "simultaneous drive", while in "sequential drive" they are driven for a predetermined time period consecutively from the preceding pairs at suitable time lags. In the developing operation, one end of a film to be processed is inserted into an inlet of the processing apparatus which is set in simultaneous drive and, as soon as the inserted fore end of the film reaches the outlet or discharging end of the apparatus or an entrance of a dryer which is connected to the discharging end of the processing apparatus, all the film feed rollers are temporarily stopped and then the apparatus is switched to the mode of sequential drive to drive the respective feed rollers pairs at predetermined time lags to form draped film loops in the developing, fixing and washing baths of the apparatus, thus effecting the developing, fixing and washing treatments of the film automatically without necessitating provision of film guide members in the respective treating baths.

The above and other objects, features and advantages of the invention will become clear from the following description of preferred embodiments of the invention, taken in conjunction with the accompanying drawings wherein like numerals are employed to designate like parts throughout various figures.

DETAILED DESCRIPTION OF THE INVENTION

Figure 1:
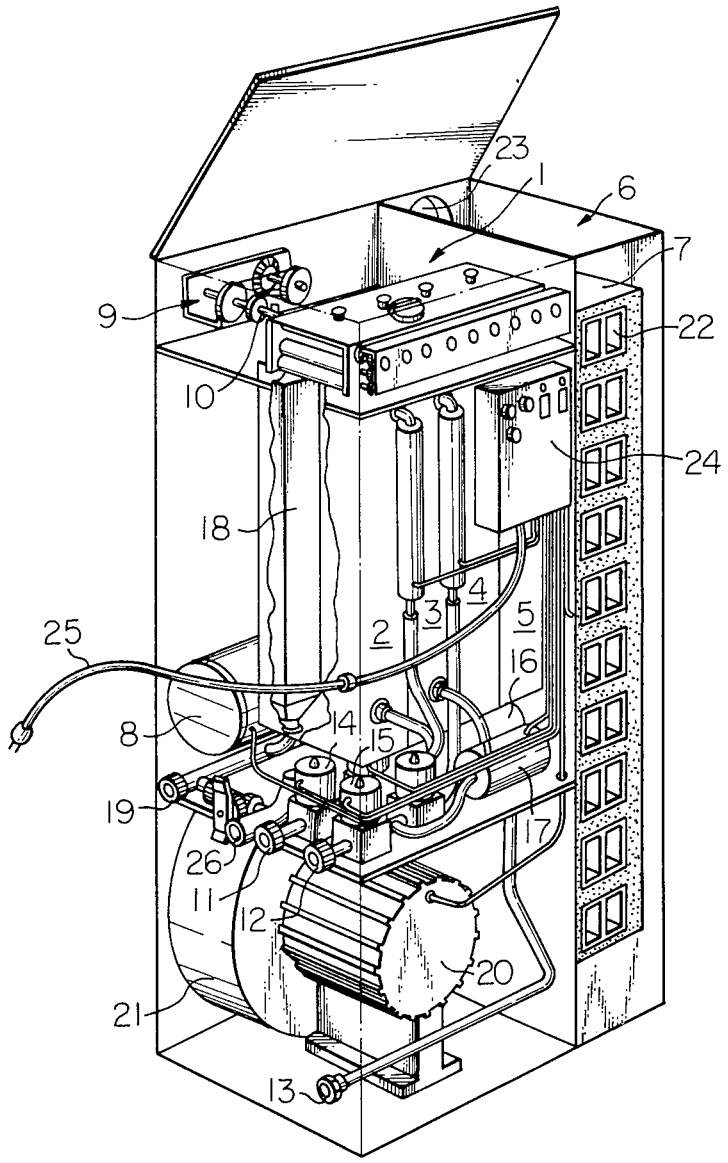
FIG. 1 is a perspective view of an elongated film processing apparatus employed for carrying out the method of the invention.

FIG. 1 shows a partially sectioned perspective view one example of the apparatus suitable for carrying out the elongated film processing method according to the invention.

Referring to FIG. 1, indicated at 1 is a film transfer unit which forms an important part of the processing apparatus of the invention, at 2 is a developing bath, at 3 is a fixing bath, and at 4 and 5 are first and second washing baths, respectively. The reference numeral 6 denotes a drying chamber for drying the film which has undergone the developing, fixing and washing treatments, the drying chamber 6 being provided therein with a heater or other suitable drying unit 7. The film transfer unit 1 is driven from an electric motor 8 the rotation of which is transmitted through a bevel gear train to a reducer 9 which has the output shaft 10 drivingly connected to the film transfer unit 1. The reference numerals 11, 12 and 13 denote feed pipes for replenishing therethrough the developing and fixing solutions and washing water, respectively. The developing and fixing solutions are fed to the developing and fixing baths 2 and 3 by means of circulating pumps 16 and 17 via make-up valves 14 and 15 which can be switched from a circulating position to a replenishing position and vice versa. The developing and fixing baths 2 and 3 are each provided therein with an overflow device 18 for collecting spent solution, the spent solution collected through the overflow device 18 being discharged through a spent solution collecting pipe 19. When it is desired to use the developing and fixing solutions without circulation, the outer ends of the feed pipes 11 and 12 are closed by a pin or plug. The reference numeral 26 indicates a pipe for discharging water therethrough. An electric motor 26 is provided for rotatingly drive a fan 21 for sending air to an air gallery provided within the drying unit 7. A film which is not shown is moved vertically along the drying unit 7 and dried by means of air flow sent from the internally provided air gallery through vertically aligned horizontal air passages 22. The air flows introduced into the drying chamber 6 through the air passages 22 are discharged to the outside of the processing apparatus through a duct 23. A switchboard 24 is provided to mount thereon the power switch, development start switch, button switches for replenishment of the developing and fixing solutions, a button switch for film set transfer, a number of pilot lamps and the like. Indicated at 25 is a connected cord.

Figure 2:
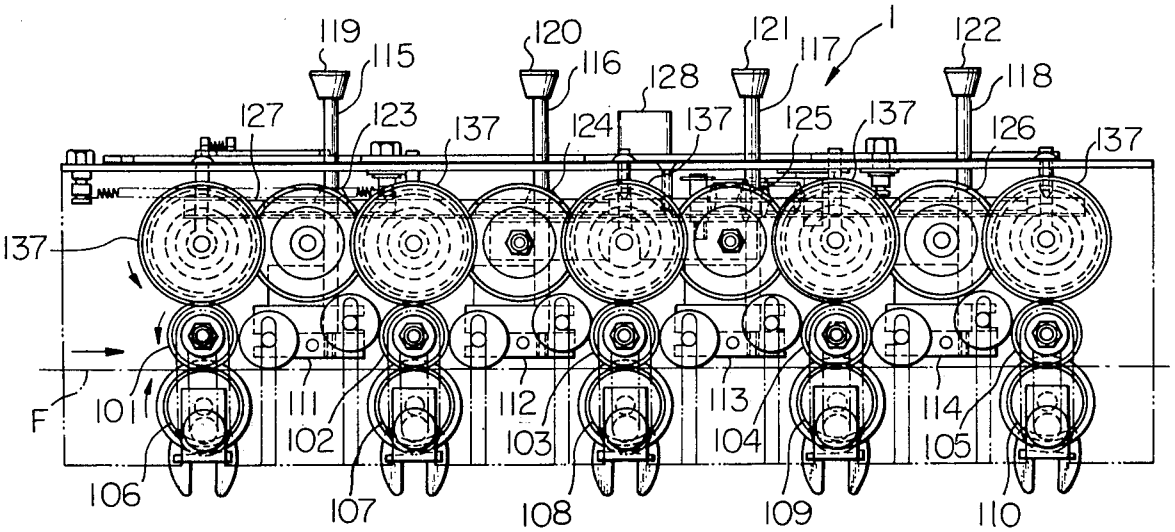
FIG. 2 is a front elevation of a film transfer unit employed in the elongated film processing apparatus according to the present invention.

FIG. 2 shows in side elevation one preferred embodiment of the film transfer unit which forms an important part of the processing apparatus shown in FIG. 1.

Referring to FIG. 2, the reference numerals 101, through 105 denote film feed rollers which make pairs with lower rollers 106 through 110, respectively. These paired film feed rollers are driven from upwardly located gears which are meshed with the train of gears fixed on each side of the respective rollers. The film feed roller pairs are shown in the drawings as being aligned in a horizontal direction but they may be staggered vertically, if desired. Film guides 111 to 114 are provided between the respective pairs of the feed rollers and each has guide rolls which are freely rotatable in forward and reverse directions. The film guides 111 to 114 are respectively provided with upwardly extending rod members 115 to 118 which are fitted at the upper free ends thereof with knobs 119 to 122. The rod members 115 to 118 have conical flanges 123 to 126 securely mounted substantially at the center portions thereof, the conical flanges 123 to 126 being able to assume selectively a film transfer position (the position shown) engaged by a film guide stopper plate 127 or a lower film processing position. The conical flanges are allowed to assume the lower film processing position by gravity upon disengagement from the film guide stopper plate 127. The reference numeral 128 denotes a knob for switching the film transfer unit between a direct film transfer position (the position of FIG. 2) and a film processing position. The film introduced into the processing apparatus is transferred in the direction indicated by arrow F.

Figure 3:
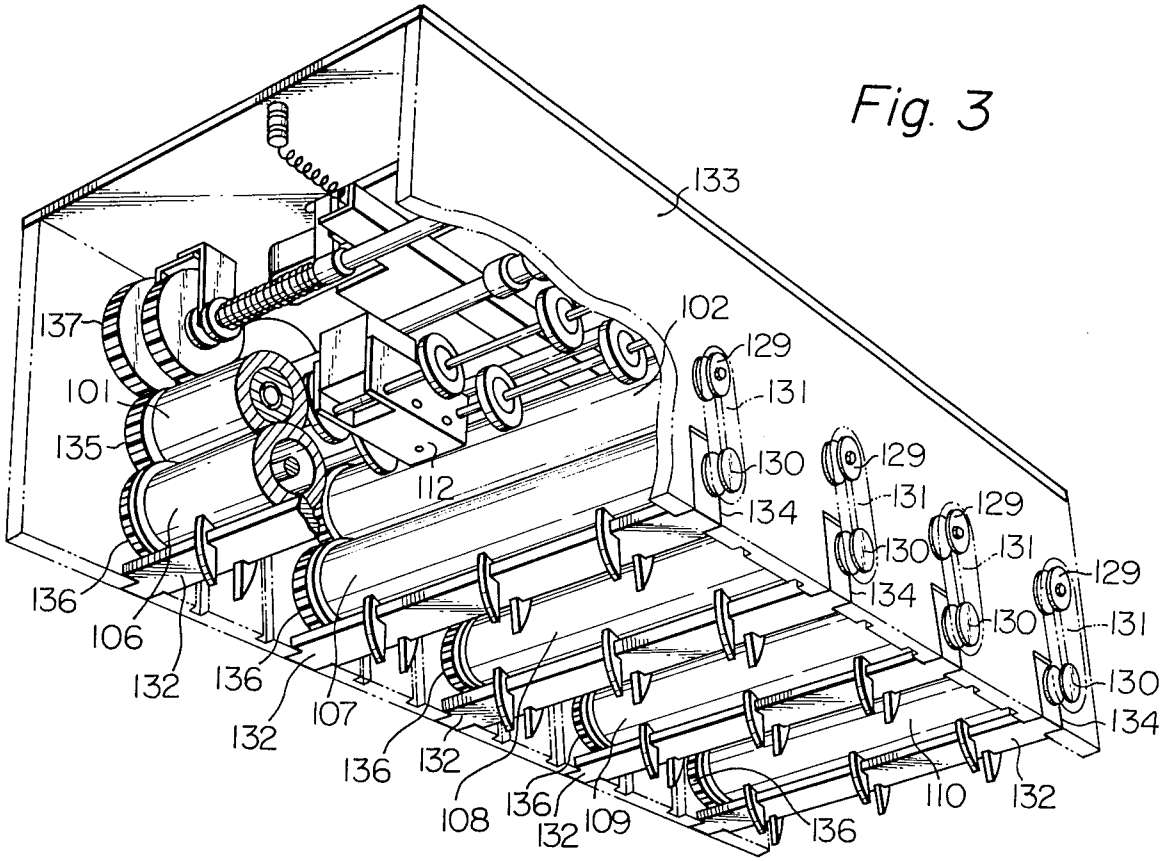
FIG. 3 is a perspective view showing the film transfer unit of FIG. 2 as seen from below at an oblique angle.

FIG. 3 shows in partially sectioned perspective view the film transfer unit of FIG. 2 as viewed from beneath. Now description is directed to those component parts which do not appear in FIG. 2 or in the explanation of FIG. 2. Designated at 129 are pulleys which are securely mounted at opposite ends of supporting shafts 101 to 105 and indicated at 130 are pulleys which are securely mounted to opposite side walls of U-shaped support frames 132 in vertical alignment with one of the upwardly mounted pulleys 129. A spring belt 131 is applied around each pair of vertically aligned upper and lower pulleys 129 and 130. The side walls of each U-shaped support frame 132 are held within slots 134 which are formed in the side walls of casing 133 and are slidingly movable along the slots 134, so that the upper and lower film feed rollers are pressed against each other by the tension in the spring belt 131. Each upper film feed roller has securely mounted at one end thereof a gear 135 which is held in meshed engagement with a gear 136 which is securely mounted at one end of the lower film feed roller. The gears 135 of the upper film feed rollers are meshed with and driven from gears 137.

The film transfer unit shown in FIGS. 2 and 3 operates as follows.

Firstly, the knob 128 is turned to set the film transfer unit in the "direct film transfer" position. Upon putting the driving motor 8 in operation, all the gears 137 are simultaneously rotated at a uniform speed in the direction indicated by arrows, so that the upper and lower film feed rollers 101 to 105 and 106 to 110 are also rotated in the directions indicated by arrows. Under these circumstances, the knobs 119 to 122 at the upper ends of the film guides 111 to 114 and the flanges 123 to 126 of the respective film guides are held in the position of FIG. 2 by engagement with the film guide stopper plate 127. Upon introducing a leading end of the film F or a leading end of guide paper which is connected to the fore end of the film F between the first paired feed rollers 101 and 106, the film F is transported to the succeeding feed roller pairs until the leading end of the film or the guide paper reaches the last pair of film feed rollers 105 and 110. As soon as a suitable length of the film F or the guide paper has advanced beyond the final film feed roller pair, the drive of the paired film feed rollers is stopped by means of a suitable automatic stop device such as a microswitch.

Then, after temporarily stopping the drive motor or stopping the operation of the film transfer unit by disconnecting a clutch, the knob 128 is turned to set the transfer unit in the film processing position, whereupon the film guide stopper plate 127 is disengaged from the respective conical flanges 123 to 126 and the film guides 111 to 114 tend to drop by gravity but are caused to rest on the film which is extended between the respective paired film feed rollers. If, under these circumstances, the operation of the film transfer unit is re-started, only the first pair of film feed rollers 101 and 106 is allowed to rotate and the other succeeding paired film feed rollers are held in a standstill state, so that the film F is draped between the first paired feed rollers 101 and 106 and the second paired feed rollers 102 and 107. While, as the conical flange 123 of the film guide 111 is disengaged from the film guide stopper plate 127, the film F is urged downwardly by the film guide 111 to form a draped loop of U-shaped, which grows larger and larger until the looped film is immersed in the developing solution in the developing bath. However, at a predetermined time interval, the second paired film feed roller 102 and 107 are actuated to rotate at the same speed with the first paired feed rollers so that the film is caused to pass through the developing solution at a constant speed to undergo the development while maintaining a draped loop of a constant size in the developing bath. Since the third paired film feed rollers 103 and 108 are actuated only after with a predetermined time lapse after the actuation of the second paired feed rollers 102 and 107, the developed film is caused to form a draped film loop between the second and third paired film feed rollers, the draped film loop being immersed gradually into the fixing solution as the size of the loop grows larger and larger. Upon actuation of the third paired feed rollers 103 and 108, the film is caused to pass through the fixing solution at a constant speed to undergo the fixing treatment, maintaining a draped loop of a constant size in the fixing bath. In a similar manner, the fourth and fifth paired film feed rollers are actuated at predetermined time intervals, the film F which has undergone the fixing treatment in the fixing bath forms draped loops in the first and second washing baths and receives the washing treatment therein, thus undergoing successively the developing, fixing, first washing and second washing treatments before it reaches the drying chamber (indicated at 6 in FIG. 1) past the last paired film feed rollers.

In the foregoing embodiment of the film transfer unit, the switching between the straight film feeding position and the film processing position of the unit is explained as being effected by way of the knob 128 and no detailed description is given with regard to the construction of the switching mechanism. However, one example of the construction of such switching mechanism will be explained in detail in connection with another embodiment of the film transfer unit which will be described hereinafter with reference to FIGS. 6 through 11.

Figure 4:
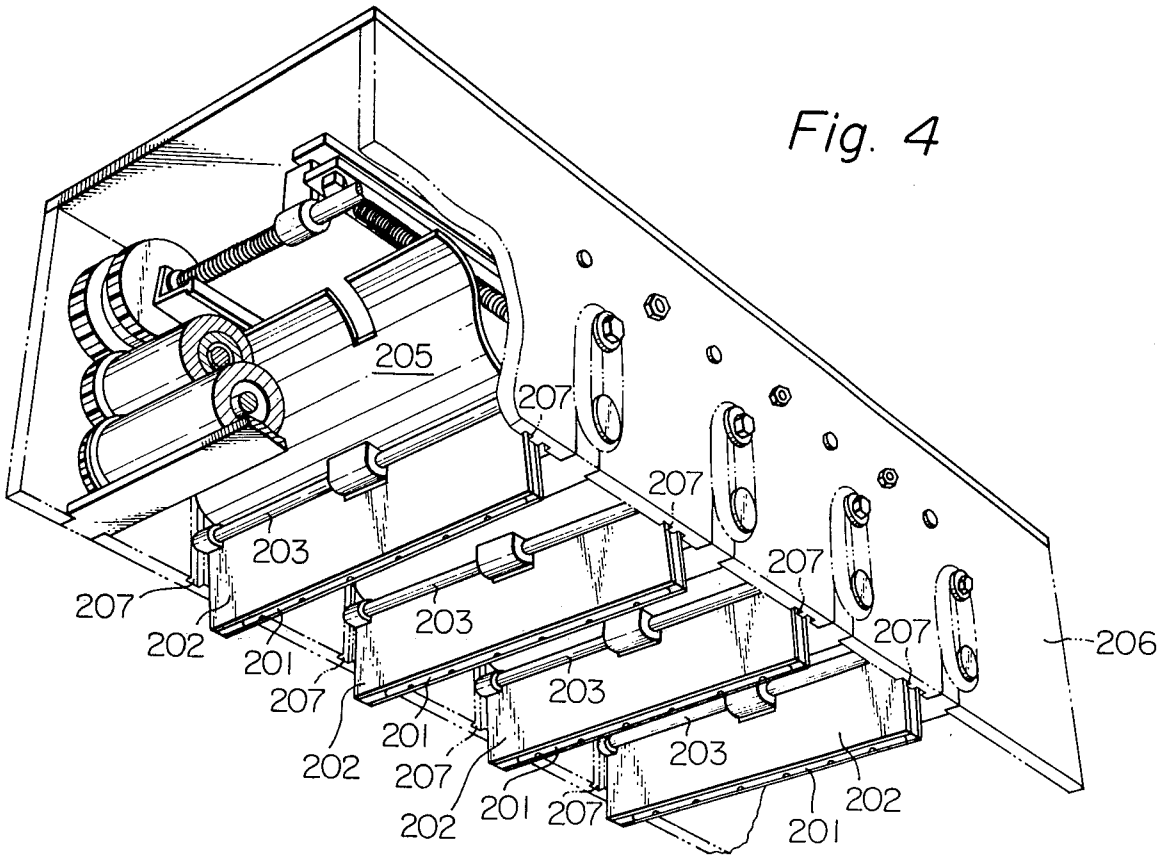
FIG. 4 is a perspective view showing another example of the film transfer unit which has a construction different from the embodiment shown in FIGS. 2 and 3.
Figure 5:
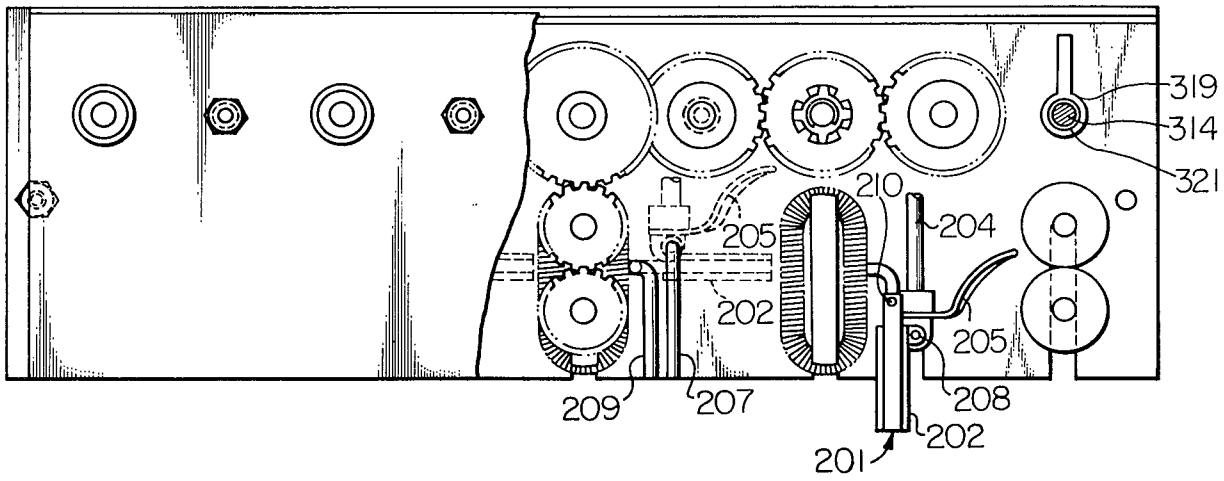
FIG. 5 is a front elevation of the film transfer unit shown in FIG. 4.

FIGS. 4 and 5 show a film transfer unit which employs a film guide of a type different from that used in the film transfer unit of FIGS. 2 and 3.

FIG. 4 is a partially broken perspective view of the film transfer unit as viewed from beneath, while FIG. 5 is a side elevation showing the construction of the film guide with part of its side wall broken away.

The film guide shown includes slit plates 202 each formed with a slit 201 for guiding the elongated film therethrough, a supporting shaft 203 located at one side of each slit plate in a direction perpendicular to the direction of travel of the film, rod members 204 extending upwardly at right angles with respect to the supporting shafts 203, the rod members 204 being provided substantially at the center portions thereof with flanges similar to the conical flanges 123 to 126 of FIG. 2, though not shown in the drawing. The rod members 204 have mounted at the upper ends thereof knobs of the nature similar to the knobs 119 to 122 of FIGS. 2. Further, the film guide includes ceiling plates 205 serving for suppressing rising movement of the film. The opposite ends of the afore-mentioned supporting shaft 203 are extended outwardly beyond the outer ends of the slit plate 202 to form a pair of first projections 208 for sliding engagement with first grooves 207 which are formed vertically in the inner wall surfaces of the side walls 206 of the casing. A pair of second projections 210 are provided at the opposite ends of each slit plate 202 for engagement with second grooves 209 which are formed in the inner wall surface of the side walls 206 of the outer casing, the second grooves 209 having major portions thereof extended in parallel to the pair of first grooves 207 but having their upper end portions turned arcuately away from the first grooves 207. A straight line connecting the pair of first grooves is contained in the plane same as that of the slit 201 through which the film is passed, while a straight line connecting the pair of second projections or the axis of the supporting shaft 203 is spaced away from the slit 201 by a predetermined distance corresponding to the distance between the first groove 207 and the linear portion of the second groove 209. Therefore, when the rod member of the film guide is pulled upwardly into its raised position where its flange is engaged by the guide stopper plate (similar to that of FIG. 2), that is to say, when the film transfer unit is in the straight transfer position, the first and second projections are located at the upper end of the first and second grooves, respectively, and are horizontally spaced away from each other, holding the slit plates 202 in horizontal positions. However, in the film processing position where the flanges are disengaged from the guide stopper plate, the film guide tends to move downwardly by gravity and, as the film begins to form a draped loop, the slit plate 202 is moved downwardly with the first and second projections in sliding engagement with the straight parallel portions of the first and second grooves, finally assuming the position as shown by solid lines on the righthand of FIG. 5. In this position, the lowermost end of the slit plate 202 is positioned under or immediately above the surface of the developing or fixing solution so that the looped film is urged into the solution in a secure manner without troubles such as deposition of bubbles or floating on the surface of the solution.

The component parts designated at 314, 319 and 321 in FIG. 5 will be explained hereinlater with reference to FIGS. 6 and 7.

Figure 6:
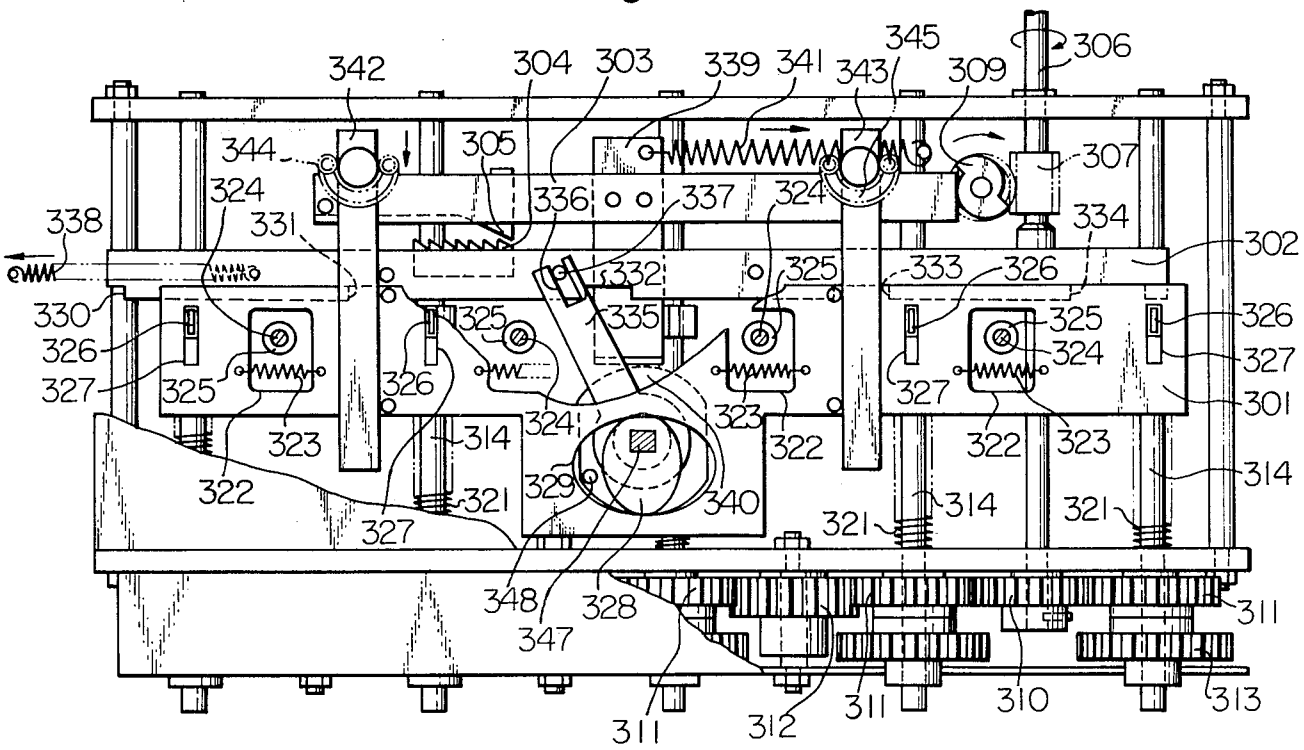
FIG. 6 is a plan view of a switching mechanism useful in combination with the film transfer unit for switching the mode of operation of the paired film feed rollers.
Figure 7:
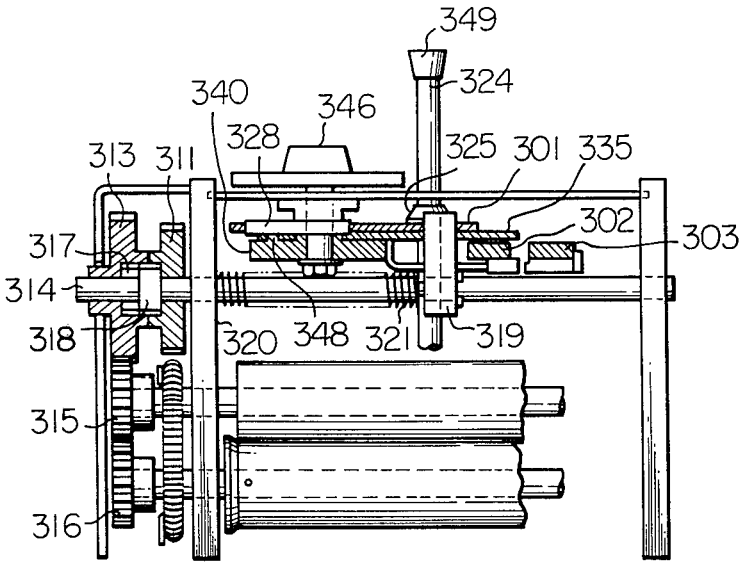
FIG. 7 is a side elevation of the roller switching mechanism shown in FIG. 6.

FIG. 6 shows in a plan view one example of the switching mechanism for switching the operation of the paired film feed rollers employed in the film transfer unit of the present invention and FIG. 7 is a side elevation of the same switching mechanism.

Referring to FIGS. 6 and 7, indicated at 301 is a control panel, at 302 is a cam rod, at 303 is a reciprocating rod member, at 304 is a ratchet member which is secured to the cam rod 302, and at 305 is a pawl secured to the reciprocating rod member 303 and engageable with the ratchet member 304. A driving shaft 306 has mounted thereon a worm 307 which is held in meshed engagement with a worm gear 308. A jumping cam 309 is mounted on the same common shaft with the worm gear 308 for driving the afore-mentioned reciprocating rod. A main driving gear 310 is mounted securely at the digital end of the driving shaft 306 for driving the transmission gears 311 which are mounted securely at one ends of the shafts 314 of the respective paired film feed rollers. The reference numeral 312 denotes an idle gear for transmitting the rotation of the main drive gear 310 to those transmission gears which are not directly meshed with the main drive gear 310. The rotation of the transmission gear is transmitted to the gears 315 and 316 which are securely mounted at one end of the paired film feed rollers, by means of a feed roller driving gear 313 which is loosely fitted at one end of the shaft 314. In this connection, the gears 315 and 316 correspond to the gears 135 and 136 and the feed roller driving gear 313 corresponds to the gear 137 of FIG. 3, respectively. The transmission gear 311 and the feed roller driving gear 313 have recesses each with a spline-shaped side wall as shown in FIG. 7, the recesses forming a small chamber 317 for receiving a spline wheel 318 which is securely mounted on the shaft 314. The shaft 314 has secured to the other end thereof a flange 319 which is in the form of a key hole as shown in FIG. 5 having a projection 326 as shown in FIG. 6. A compression spring 321 is interposed between the flange 319 and an inner wall surface 320 of the casing.

The control plate 301 is formed with a number of windows or openings 322 at a predetermined distance from each other to correspond the postions of the respective rod members 324 (similar to the rod members 115 to 118 of FIG. 2) for receiving the same. Each of the openings 322 has tensioned thereacross a relatively weak spring member 323 for stopping the flange 325 which is securely mounted on the rod member 324. The control plate 301 is further provided with a number of slits 327 in positions corresponding to projections 326 on the respective flanges 319 of the shafts 314 for sliding engagement therewith. Furthermore, an oval opening 329 is formed in the control plate 301 for engagement with an eccentric can member 328 which will be explained hereinlater.

The cam rod 302 has notches 330 through 334 (FIG. 10) in one side thereof for engagement with the projections 326 of the flanges 319 mentioned above, the notches 330 to 334 being increased in width from the left to the right as seen in the drawing. Furthermore, the cam rod 302 has securely planted therein a pin member 337 which is engageable with an indented groove 336 at the fore end of a feed arm 335 which will be explained hereinlater. The whole body of the cam rod 302 is constantly urged to the left, as seen in the drawing, by tension in a spring 338 which has one end secured to the outer casing.

The reciprocating rod member 303 has secured substantially to the center portion thereof a transverse bar 339 the end face of which is held in contact with a ratchet control cam 340 which will be described in detail hereinlater. The righthand end of the reciprocating rod member 303 is constantly pressed against the jumping cam member 309 by the action of a spring 341. The reference numerals 342 and 343 designate sliding guide plates which are provided with a roller or ball member, not shown, in contact with the upper surface of the reciprocating rod member 303 for assisting the movement of the reciprocating rod which is constantly pulled toward the cam rod 302 under the influence of the tension in springs 344 and 345.

Referring to FIG. 7, the knob 346 corresponding to the knob 128 of FIG. 2 has a downwardly extending shaft 347 on which are mounted all the cam members required for controlling the movement of the control plate 301, cam rod 302 and reciprocating rod 303. More particularly, the shaft 347 has mounted thereon, from above, an eccentric cam 328, a feed arm 355 and a ratchet control cam 340 with a pin 348. The eccentric cam 328 and ratchet control cam 340 are securely mounted on a common shaft 347 and rotatble therewith. The feed arm 335 is loosely fitted over the boss which is provided at the center of the aforementioned ratchet control cam member 340 and capable of making rotational movement relative thereto though it is limited to a certain range by means of a pin 348 planted on the ratchet control cam 340 and a pin 337 planted on the cam rod 302.

The operations by the switching mechanism of FIGS. 6 and 7 in switching the mode of operation of the film transfer unit, particularly the film feed rollers, will now be explained with reference to FIGS. 8 through 11.

Figure 8:
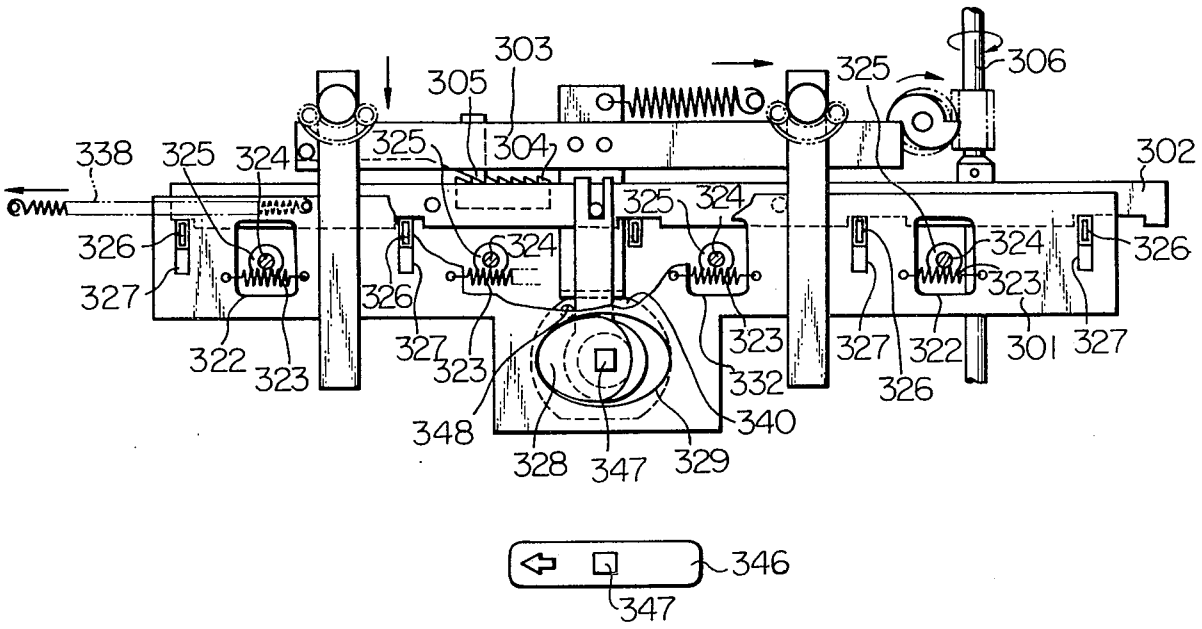
FIGS. 8 through 11 are views employed to explain the operations of the feed rollers switching mechanism shown in FIG. 6.

Upon turning the knob 346 or the shaft 347 of FIG. 6 through 90° to the right, as seen in the drawing, the film transfer unit assumes the "straight feed" position shown in FIG. 8, where the flat portion of the ratchet control cam 340 contacts the end face of the transverse bar 339, so that the reciprocating rod 303 which has secured thereto the pawl 305 is pressed by the springs 344 and 345 and moved downwardly along the sliding guide plates 342 and 343. While, the feed arm 335 is pushed at the base portion thereof and caused to rotate to the right by the pin member 348 on the ratchet control cam 340, moving the cam rod 302 to the right against the tension in the spring 338, as shown in FIG. 8. On the other hand, the larger diameter of the eccentric cam member 328 is directed to the left, so that the control plate 301 is moved upwardly and engages with the ratched 304 which is fixed on the cam rod 302. At the same time, the flanges 319 which have the respective projections held in engagement with the slits 327 of the control plate 301 are moved upwardly together with the upward movement of the slits 327 by the action of the spring 321 and brought into the notches 330 to 334 in the cam rod 302. The shafts 314, which are formed integrally with the flanges 319, are also moved upwardly as seen in FIG. 6 or to the right as seen in FIG. 7, along with the flanges 319. As a result, the spline wheel 318, which is fixedly mounted on the shaft 314 within the cavity formed by the recesss of the transmission gear 311 and the feed roller driving gear 313, is moved toward the transmission gear 311, thereby connecting the transmission gear 311 with the feed roller driving gear 313. If, under these circumstances, the driving shaft 306 is rotated, all the film feed rollers are rotated simultaneously by the driving gear at the fore end of the driving shaft 306 through the transmission gears 311 and feed roller driving gears 313.

Furthermore, under these circumstances, the springs 323 which are extending across the openings 322 in the control plate 301 are positioned close to the rod members 324 of the film guide, so that, if the rod members 324 are lifted by way of the knob 349 as shown in FIG. 7, the flanges 325 on the respective rods 324 are stopped by the springs 323, maintaining the film guides in the position as shown at 111 in FIG. 2 or in the position as shown by broken lines at 202 in FIG. 5.

Therefore, if a length of film F is fed to the film inlet at one side of the apparatus (e.g., at the lefthand in FIG. 2), it is introduced into the interior of the film transfer unit by the action of the first pair of the film feed rollers and transferred to the next paired rollers via lower side of the film guide 111 (FIG. 2) or through the slit of the film guide 202 shown by broken lines (FIG. 5). In the same manner, the film F is transferred to the film feed rollers of the last stage, thus completing the preparations for the subsequent film processing operations.

Figure 9:
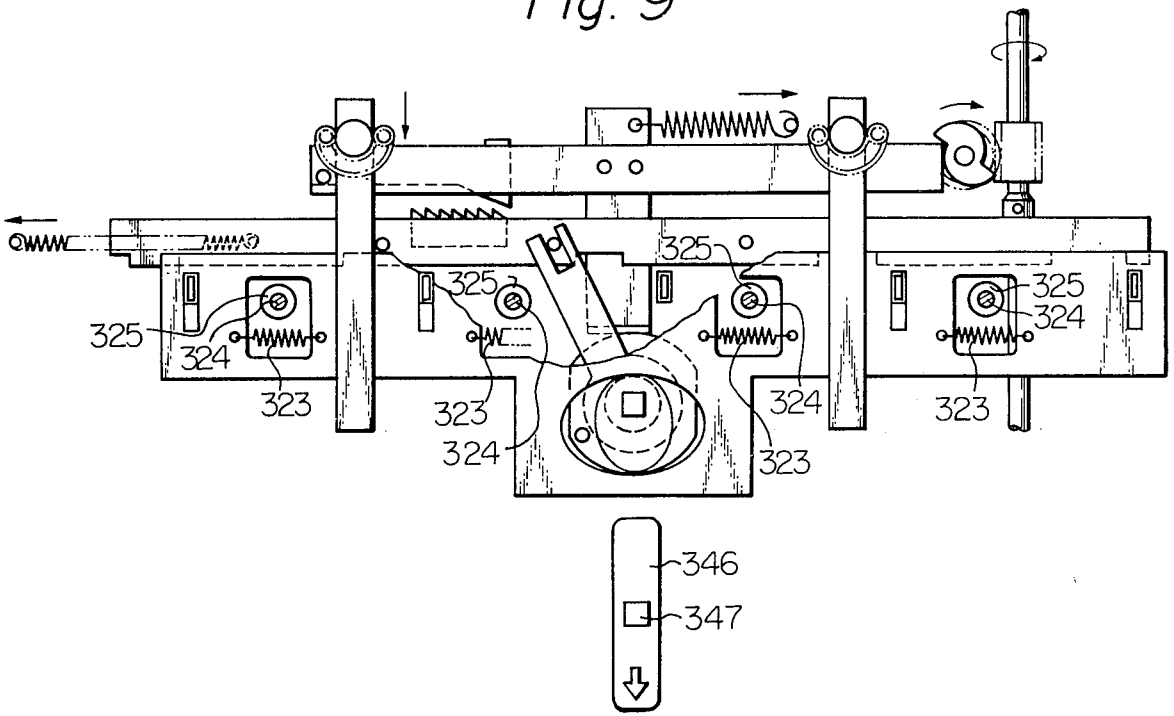

In order to set the film transfer unit in the "film processing position", it suffices to turn the knob 346 to the left through 180°. FIG. 9 shows the transfer unit in a transitive state which is assumed when switching from the "straight feed" to the "film processing" position, more particularly, the state assumed when the knob 346 is turned 90° to the left. This transitive state is same as the position of FIG. 6 and thus no further explanation is given herein to avoid repetition. It may be mentioned, however, that even if the flanges 325 of the film guides are disengaged from the springs 323, the film guides do not drop by gravity to their lowermost position since either the film F is extended beneath the guides or passed through their slits. The film guides are lowered gradually as the film grows larger in the manner as will be explained in greater detail hereinlater. The cam rod 302 is disengaged from the projections 326 and urged to the left by the action of the spring 338, assuming its leftmost position upon abutment against a stopper member which is not shown.

Figure 10:
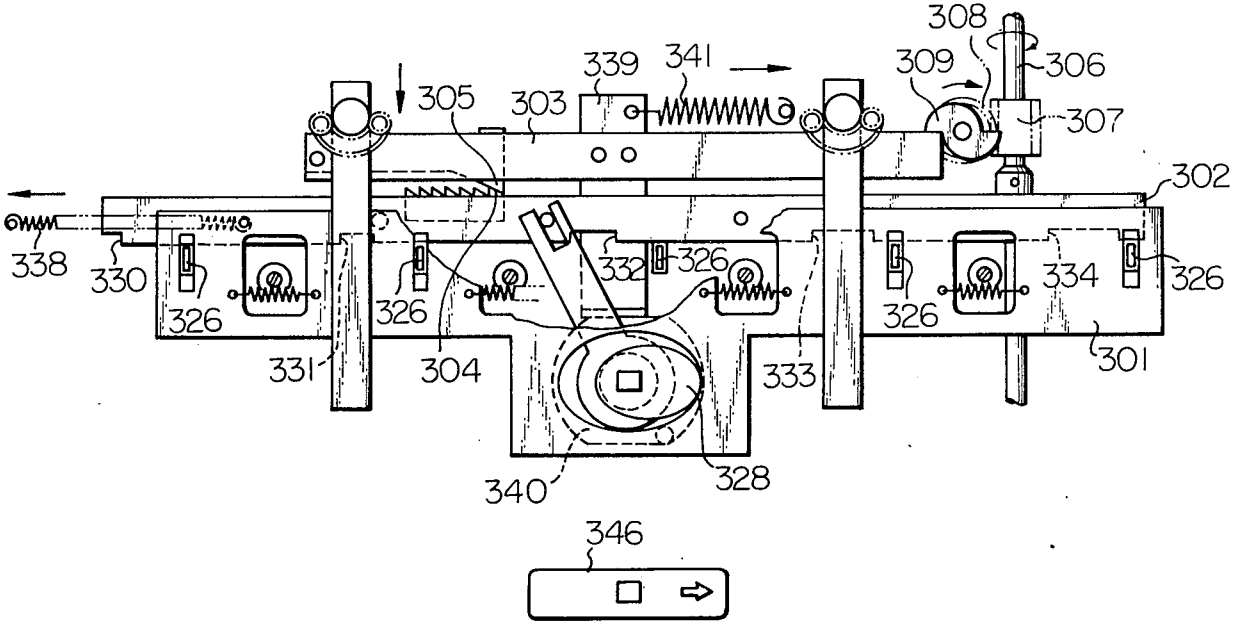
Figure 11:
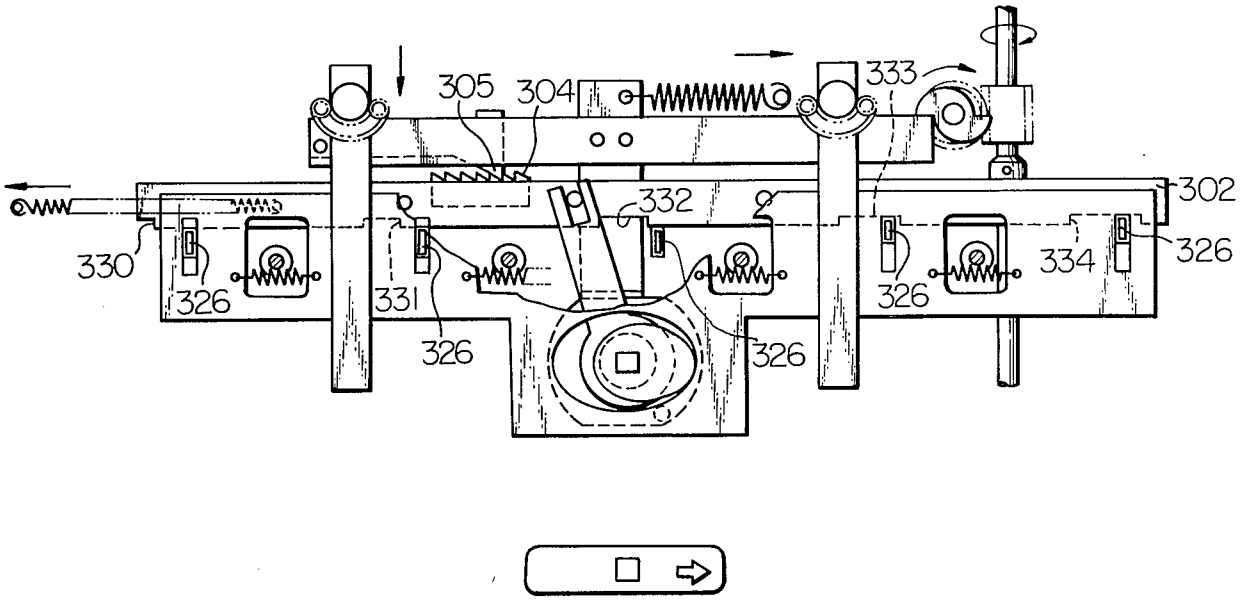

FIG. 10 shows the transfer unit set in the "film processing" position by turning the knob 346 to the left further 90° from the position of FIG. 9. The eccentric cam member 328 and control plate 301 assume the transitive state when switched from the positions of FIG. 8 to the positions of FIG. 10, so that the cam rod 302 is disengaged from the respective projections 326 and urged to the left by the action of the spring 338. Therefore, when the larger diameter portion of the eccentric cam member 328 is directed to the right as shown in FIG. 10, the projections 326 are positioned outside the notches 330 to 334 of the cam rod 302. Further, since the flat portion of the cam 340 comes into contact with the end face of the transverse bar 339, the reciprocating rod 303 which is mounted on the transverse bar 339 comes close to the cam rod 302, the pawl 305 fixed on the reciprocating rod 303 contacting a tooth at the righthand end of the ratchet on the cam rod 302.

Under these circumstances, as in FIG. 6, all of the shafts 314 are held in the downwardly pressed positions, so that the spline wheel 318 which is positioned within the cavity in the gears 311 and 313 at the outer end of each shaft 314 is pressed against the gear 313, breaking the connection between the gears 311 and 313 (FIG. 7). Therefore, even if the driving shaft 306 is actuated, its rotation is not immediately transmitted to the respective paired film feed rollers holding the same in a standstill state. However, upon actuation of the driving shaft 306, the worm gear 308 and the jumping cam member 309 which is mounted on the common shaft with the worm gear 308 are rotated by means of the worm 307 which is rotatable with the driving shaft 306, moving to the left the reciprocating rod 303 which is abutted against the cam member. By a half revolution of the jumping cam 309, the reciprocating rod member 303 is moved to the left by a distance corresponding to one pitch of the ratchet 304, the reciprocating rod 303 reaching the stepped portion of the jumping cam member 309 and returning instantaneously to its rightmost position when the pawl 305 is meshed with the next groove of the ratchet. As the spring 341 is stronger than the spring 338, the reciprocating rod 303 moves by its pawl 305 the cam rod 302 to the right by a distance corresponding to one pitch of the ratchet when returning to the rightmost position. As a result, the rightmost projection 326 drops into the notch 334 of the cam rod 302, so that only the shaft 314 which carries the rightmost projection 326 is allowed to move upwardly as seen in FIG. 6 or to the right as seen in FIG. 7, establishing the connection between the gears 311 and 313 by means of the spline wheel 318. Thus, only the first pair of the film feed rollers is actuated to rotate, forming a loop of draped film between the first and second pairs of the film feed rollers. The loop of the draped film gradually grows larger and larger until submerged in the solution in the developing bath.

While the loop of the draped film is growing, the reciprocating rod 303 is again moved to the left by the rotation of the jumping cam and as soon as the pawl 305 engages with the next tooth of the ratchet 304, the rod is pulled to the right again. In the meantime, the cam rod 302 repeats the afore-mentioned operation and moves to the right further by a distance corresponding to one pitch of the ratchet 304, causing the projection 326 on the shaft 314 of the second feed roller pair to drop into the notch 333 of the cam rod 302, as shown particularly in FIG. 11. The projection 326 is still kept in the notch 334, so that only the first and second pairs of the film feed rollers are rotated and other pairs are maintained in a standstill state. At this stage, the first and second paired feed rollers are rotated at the same speed, so that the loop of draped film stops its growth and the film is transferred through the solution in the developing bath, maintaining a loop of a constant size therein. Since the third pair of the film feed rollers is still held in a standstill state, a loop of draped film is formed between the second and third pairs. The draped film loop grows gradually larger and larger until it is immersed in the solution in the fixing bath.

In a similar manner, the loop of the draped film is formed in the succeeding treating baths by actuating the feed roller pairs of the subsequent stages at predetermined time lags.

It should be understood that the feed roller control mechanism herein described with reference to FIG. 6 and the succeeding figures is given only by way of example and instead of the mechanical means there may by employed electric devices such as microswitches in controlling the respective paired film feed rollers. The use of the mechanical means is advantageous in that the processing apparatus allows easier maintenance including the cleaning of various component parts.

What is claimed is:

1. A draped film loop forming device for use in automatic elongated film developing apparatus, comprising: a plurality of paired film feed rollers located along a predetermined film passage; a roller gear mounted on one of said paired rollers; one film feed roller driving gear provided for each of said roller gears for engagement therewith; one set of transmission gears provided for each of said feed roller driving gears for engagement therewith; one clutch means provided for each set of said feed roller driving gear and transmission gear for connecting the same integrally with each other; driving means for driving said transmission gears; and a clutch operating mechanism for controlling and switching the mode of operation of said plurality of paired film feed rollers between a simultaneous drive mode where all of said plurality of paired film feed rollers are rotated simultaneously at a uniform speed and a sequential drive mode where each pair of said plurality of paired film feed rollers are rotated sequentially from the preceding pair at predetermined time intervals.

2. A draped film loop forming device for use in automatic elongated film developing apparatus, comprising: a plurality of paired film feed rollers located along a predetermined film passage; a roller gear mounted on one of said paired rollers; one film feed roller driving gear provided for each of said roller gears for engagement therewith; one set of transmission gears provided for each of said feed roller driving gears of engagement therewith; one clutch means provided for each set of said feed roller driving gear and transmission gear for connecting the same integrally with each other; driving means for driving said transmission gears simultaneously; and a clutch operating mechanism adapted to actuate said clutches sequentially from those of the preceding pairs of said film feed rollers at predetermined time intervals, said clutch means including a clutch member movable between a connecting position for integrally coupling said transmission gear and feed roller driving gear integrally with each other; a supporting shaft member for supporting said clutch member, and a projection provided on said supporting shaft member; said clutch operating mechanism including an advancing pawl movable reciprocatingly and intermittently in association with said driving means, a cam rod having a ratchet movable by one pitch at each one reciprocating movement of said advancing pawl and a number of notches formed in positions corresponding to said clutch means, and means for pressing said projection of said clutch means against said notches of said cam rod; said projections of said clutch means being caused to drop into the corresponding notches on said cam rod sequentially from the projection of the preceding feed roller pair every time when said cam rod is moved by a distance corresponding to one pitch of said ratchet.

3. A draped film loop forming device as set forth in claim 2, further comprising advancing pawl returning means adapted to disengage said advancing pawl from said ratchet and return the same to its original position, and cam rod returning means adapted to disengage said projections from said notches on said cam rod and return the same to their original positions.

* * * * *